US006267402B1

(12) United States Patent
Julien

(10) Patent No.: US 6,267,402 B1
(45) Date of Patent: Jul. 31, 2001

(54) NITINOL SKI STRUCTURES

(75) Inventor: Gerald J. Julien, Edgewood, WA (US)

(73) Assignee: Nitinol Technologies, Inc., Edgewood, WA (US)

( * ) Notice: Subject to any disclaimer, the term of this patent is extended or adjusted under 35 U.S.C. 154(b) by 0 days.

(21) Appl. No.: 09/539,642

(22) Filed: Mar. 30, 2000

Related U.S. Application Data

(60) Provisional application No. 60/127,167, filed on Mar. 30, 1999.

(51) Int. Cl.[7] ..... A63C 5/07
(52) U.S. Cl. ..... 280/602; 280/608
(58) Field of Search ..... 280/602, 609, 280/608

(56) References Cited

U.S. PATENT DOCUMENTS

| | | | | |
|---|---|---|---|---|
| 3,747,947 | * | 7/1973 | Gunzel | 280/602 |
| 4,071,264 | * | 1/1978 | Legrand et al. | 280/602 |
| 4,233,098 | * | 11/1980 | Urbain | 280/609 |
| 4,405,149 | * | 9/1983 | Piegay | 280/602 |
| 4,563,020 | * | 1/1986 | Arieh et al. | 280/602 |
| 4,627,635 | * | 12/1986 | Koleda | 280/602 |
| 4,674,763 | * | 6/1987 | Schlagenhaufer | 280/602 |
| 4,804,200 | * | 2/1989 | Kuchler | 280/602 |
| 4,848,784 | * | 7/1989 | Scherubl | 280/602 |
| 4,875,702 | * | 10/1989 | Scherubl | 280/602 |
| 4,995,630 | * | 2/1991 | Piegay | 280/602 |
| 5,000,475 | * | 3/1991 | Gagneux et al. | 280/602 |
| 5,002,300 | * | 3/1991 | Pascal et al. | 280/602 |
| 5,002,301 | * | 3/1991 | Cagneux et al. | 280/602 |
| 5,005,678 | * | 4/1991 | Julien et al. | 188/378 |
| 5,033,765 | * | 7/1991 | Cagneux et al. | 280/602 |
| 5,035,442 | * | 7/1991 | Arnsteiner | 280/602 |
| 5,092,618 | * | 3/1992 | Mayr | 280/602 |
| 5,143,394 | * | 9/1992 | Piana | 280/602 |
| 5,199,734 | * | 4/1993 | Mayr | 280/602 |
| 5,284,357 | * | 2/1994 | Tinkler | 280/602 |
| 5,333,889 | * | 8/1994 | Piegay et al. | 280/602 |
| 5,398,462 | * | 3/1995 | Berlin et al. | 52/1 |
| 5,408,932 | * | 4/1995 | Hesse et al. | 102/501 |
| 5,417,448 | * | 5/1995 | Le Masson et al. | 280/602 |
| 5,441,296 | * | 8/1995 | Phelipon et al. | 280/602 |
| 5,465,994 | * | 11/1995 | Commier et al. | 280/602 |
| 5,597,170 | * | 1/1997 | Le Masson et al. | 280/602 |
| 5,674,135 | * | 10/1997 | Franco et al. | 280/602 |
| 5,678,840 | * | 10/1997 | Simonian | 280/602 |
| 5,806,875 | * | 9/1998 | Bonvallet | 280/602 |
| 5,915,716 | * | 6/1999 | Artus | 280/602 |
| 5,954,356 | * | 9/1999 | Busby, Jr. et al. | 280/602 |

* cited by examiner

*Primary Examiner*—Brian L. Johnson
*Assistant Examiner*—Joselynn Z. Sliteris
(74) *Attorney, Agent, or Firm*—J. Michael Neary

(57) ABSTRACT

A torsionally-damped ski having a durable, low friction ski base and non-rusting durable ski edges that have exceptional edge-retaining qualities, including an elongated snow-contacting base surface made of a Nitinol sheet having two opposed longitudinal edges on opposite sides of an elongated medial portion. A Nitinol ski edge structure extends longitudinally along both of the edges of the sheet, having a greater thickness than the medial portion of the sheet. The edge structures form an integral part of the Nitinol base sheet by welding the sheet along opposite edges thereof to the edge structures. Preferably, the ski edge structure is Type 60 Nitinol. The base sheet can be superelastic Nitinol or Martensitic Nitinol having shape memory characteristics. A torsional vibration structure is built into the ski, including Nitinol structures extending along one or more axes lying oblique to the longitudinal axis of the ski.

16 Claims, 5 Drawing Sheets

NITINOL SKI STRUCTURES

This is related to U.S. Provisional Application No. 60/127,167 entitled "Nitinol Ski Structures" which was filed on Mar. 30, 1999.

BACKGROUND OF THE INVENTION

Since the advent of modern skis in the 1940's and 1950's, ski manufacturers have worked, with considerable success, to design and build skis that are torsionally stiff and have longitudinal stiffness that can be selected for each type and size of ski, enabling the customer to select a ski optimized for the type of snow conditions, skiing style and size of that customer. With improvements in skis, skiing has become easier to learn and has become a very popular recreational activity, to the great profit of ski equipment manufacturers and ski resorts.

Even with the improvements made to skis in the last ten or so years, there remain some problems that have resisted the efforts of large ski manufacturers to solve. One such problem is ski chatter when skiing in icy conditions. Ski chatter is a natural result of a stiff ski weighted in the center by the skier's weight and extending stiffly forward and rearward therefrom to the tip and tail, like a big leaf spring. When the tip and/or tail is perturbed by the rough ice surface, the ski vibrates, or "chatters" on the ice. The chatter has a deleterious effect of the ability of the ski edges to hold in the groove they are cutting in the ice, and it can cause the ski to break loose and skid down hill. It also causes a sense of roughness and poor control to the skier.

Ski manufacturers have tried mightily to solve the problem of chatter. Among such attempts to reduce chatter are dampers of various kinds attached to the ski intended to absorb vibration energy and thereby reduce the amplitude and/or reduce the frequency of the vibration. One difficulty with dampers is in achieving optimal damping to reduce chatter sufficiently without reducing the springiness of the ski so much that it would make a "dead" ski. These schemes have been only partially successful and ski chatter remains a problem, particularly with aggressive skiers and ski racers.

Another problem that ski manufacturers have been unable to solve is developing a durable ski base material that can withstand abuse and provide low friction with the snow surface. The ski base now commonly used is sintered polyethylene. It is relatively soft and easily gouged by rocks in the snow, a common occurrence. Gouges can be repaired, at least temporarily, using melted plastic material in a "P-tex candle" but more serious and unrepairable damage can be done if a rock gouges the ski base and hooks the edge structure. The force of the moving ski and skier concentrated at the inside of the edge can pull the edge piece right out of the ski. Although this type of damage is rare, ski manufacturers and skiers would welcome a ski improvement that eliminates this kind of base damage and edge piece pull-out.

Ski edges are made of hard, high strength steel to provide the hardness and strength needed for the severe demands on that structure. The edge occasionally passes over rocks, and must be hard enough to resist gouges and burrs that would affect the ski performance. The edge pieces also contribute some degree of longitudinal stiffness to the ski and that stiffness is difficult to control without changing the size of the edge pieces. Most annoying to skiers is the speed at which the ski edges become dull and rusty. After returning from a hard day of skiing, the skier is obliged to resist the temptation to hop right into the hot tub because he knows that his ski edges will be rusted the next morning if he fails to dry them off before beginning the evening's activities. The rust makes the skis run slower, but more seriously, it attacks first the sharp edge of the edge piece, dulling it quickly. A ski with hard and durable edges that are immune to rust or corrosion would be a welcome improvement to skiers.

SUMMARY OF THE INVENTION

Accordingly, this invention provides a lively ski with a damping structure that can be designed and/or tuned to provide damping for skis to eliminate the most serious effects of chatter without deadening the ski. The invention also provides a ski base that is extremely slippery and robust, and can be repaired to as-new condition easily, quickly and inexpensively by the owner of the skis without expensive equipment or special skill. This invention also provides ski edges that are immune to rust and corrosion, are long lasting and resistant to damage by rocks, and can be made so that they are absolutely immune from being pulled out by rocks or other impacts.

These benefits are provided by a ski having Nitinol structures embedded into the torsion box of the ski so that the Nitinol structures are strained when the ski flexes, and the vibration energy of the flexing ski is absorbed by the Nitinol structures and converted to heat. The ski base is made of a sheet of Nitinol that is very slippery and has a shape memory effect, enabling any dents or gouges to be removed merely by heating with a blow dryer or an iron. The sheet Nitinol base can also be treated to have an extremely hard and slippery surface that can be colored with a permanent integral color for beauty and marketing pizzazz. The invention also provides Nitinol ski edges that are immune from rust and corrosion and are hard and tough to resist damage from rocks. The ski edges can be made integral with the ski base to provide an integral base structure that can be designed to offer any desired stiffness and whose edges cannot be pulled out under any circumstances.

DESCRIPTION OF THE DRAWINGS

The invention and its many attendant benefits and advantages will become better understood upon reading the following detailed description of the preferred embodiments in conjunction with the following drawings, wherein.

DETAILED DESCRIPTION OF THE PREFERRED EMBODIMENTS

Figure 1:
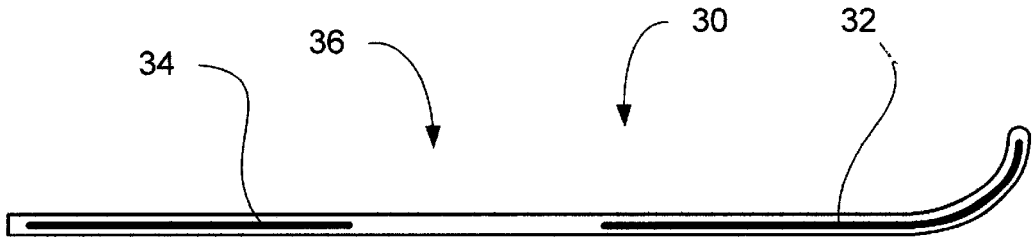
FIG. 1 is a schematic sectional side elevation of a ski having Nitinol damping structures embedded in the ski in accordance with this invention.

Turning now to the drawings, wherein like reference characters designate identical or corresponding parts, and more particularly to FIG. 1 thereof, a ski 30 is shown schematically having Nitinol strips 32 and 34 embedded in the ski forward and rearward, respectively, of the binding attachment area 36, such that flexing of the ski during vibration or chattering causes the Nitinol strips to flex and strain. The strain is maximized when the Nitinol strips 32 and 34 are embedded near the top or bottom surfaces of the ski.

Reference is made to "skis" herein, but it will be understood that the invention applies equally well if not better to snowboards. Therefore, the term "ski" as used in this description and in the claims should also be interpreted to include the term "snowboard".

Figure 2:
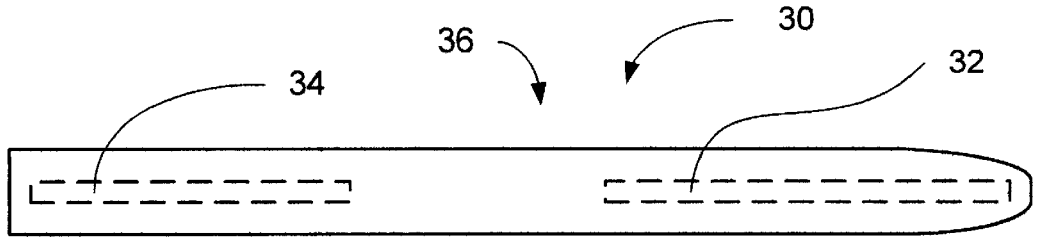
FIG. 2 is a plan view of the ski shown in FIG. 1.
Figure 3:
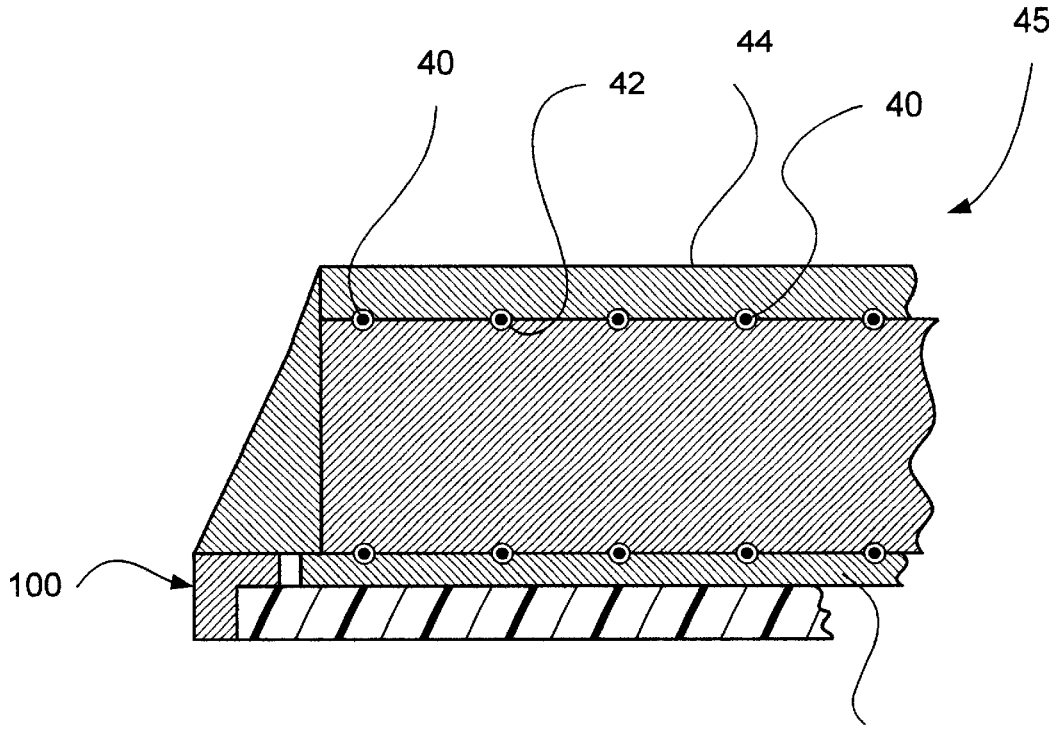
FIG. 3 is a sectional end elevation of a ski having Nitinol damping wires and separate Nitinol edges in accordance with this invention.

In FIG. 3, the Nitinol strips 32 and 34 of FIGS. 1 and 2 have been replaced with Nitinol wires 40 disposed in narrow tubes 42 between a top sheet 44 of the ski 45 and the core 48, and also between the bottom sheet 50 and the core 48. The tubes 42 lie in aligned grooves in the top sheet and the core, and in aligned grooves in the bottom sheet and the core to prevent shifting during skiing. The grooves may be omitted if the wires 40 remain in place without shifting during skiing. The tubes 42 prevent the adhesive that binds the top and bottom sheets 44 and 50 to the core 48 from preventing the wires 40 from straining freely along their length for maximum damping. However, Nitinol is very difficult to bond to anything, and the tubes 42 may be unnecessary and may be omitted if the damping provided by the wires unprotected by the tubes 42 is sufficient.

The Nitinol of the wires 40 is preferably 55 Nitinol, which is an atomic 50/50 intermetallic compound of nickel and titanium having about 55% nickel and 54% titanium by weight. The Nitinol has a Martensitic state and an Austenitic state on opposite sides of a transition temperature of about 80° C. The Nitinol in its Martensitic state has very high damping capacity, on the order of about 60% of input strain energy.

If the damping provided by the 55 Nitinol wires 40 is excessive and makes the ski insufficiently lively, some of the wires 40 may be removed or may be replaced with superelastic Nitinol wires. Superelastic Nitinol is a known composition, very nearly the same as 55 Nitinol, but is cold worked to give it remarkable elastic properties. Although providing somewhat less damping capacity than the 55 Nitinol, superelastic Nitinol also has good damping capacity. The compination of extreme elasticity (technically known as "pseudoelasticity") and damping capacity may make superelastic Nitinol a better material for all the wires 40 in the ski structure shown in FIG. 3.

Figure 4:
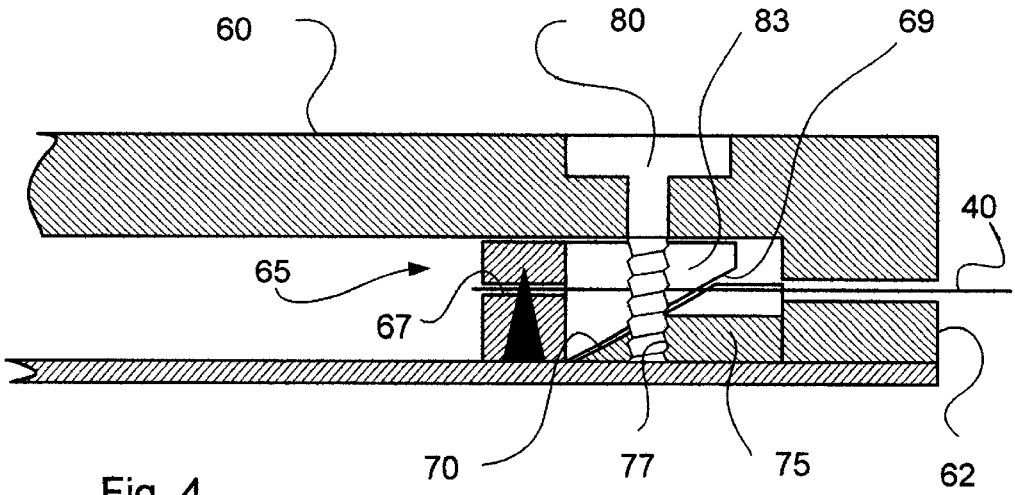
FIG. 4 is a sectional side elevation of an adjustable ski damping and stiffness mechanism in a ski binding mounting plate.

The attachment of the wires 40 adjacent the binding attachment area 36 of the ski 45 is shown in FIG. 4. This structure is of particular use in developing the ski of this invention to achieve the desired tension in the wires 40. It may also be of value to expert skiers who would want to tune the stiffness and damping of their skis for the particular conditions of the day.

The structure shown in FIG. 4 includes a titanium mounting plate 60 having a flange 62 at each end front and rear (only one flange being shown in FIG. 4). The titanium mounting plate provides a secure mounting structure that can be drilled and tapped for bomb-proof mounting of the ski bindings. The flanges 62 are drilled at spaced positions laterally across the ski at positions corresponding to the positions of the wires 40 shown in FIG. 3.

An inner wedge structure 65, laterally elongated to extend laterally across the full width of the ski, is disposed under the mounting plate 60 between the two flanges. A series of holes 67 is drilled longitudinally in the inner wedge structure 65 and each hole 67 receives an end of an individual wire 40 where it is secured by laser welding or the like. The inner wedge structure 65 has a downwardly facing wedge surface 69 which engages a corresponding upwardly facing wedge surface 70 on an outer wedge structure 75. Two tapped holes 77 (only one of which is shown in FIG. 4) in opposite ends of the outer wedge structure receive threaded shanks of two screws 80 that are seated in counterbored holes in the mounting plate 60 and are accessible to the skier through suitable access openings in the top of the ski. Slots 83 are provided in the inner wedge structure 65 to allow the screws 80 to reach the outer wedge structure 75.

In operation, the skier torques the screw 80, which lifts the outer wedge structure 75 and cams the inner wedge structure 65 to the left in FIG. 4, putting additional tension on the wires 40. Turning the screw 80 in the opposite direction lowers the outer wedge structure 75 and allows the wires 40 to pull the inner wedge structure to the right in FIG. 4 to the extent permitted by the wedge surface 70 on the outer wedge structure 75.

For lower priced skis that do not require an adjustment capability, the wires can be attached to attachment bars and fixed in known positions in the ski to provide a predetermined damping capability and stiffness.

Figure 5:
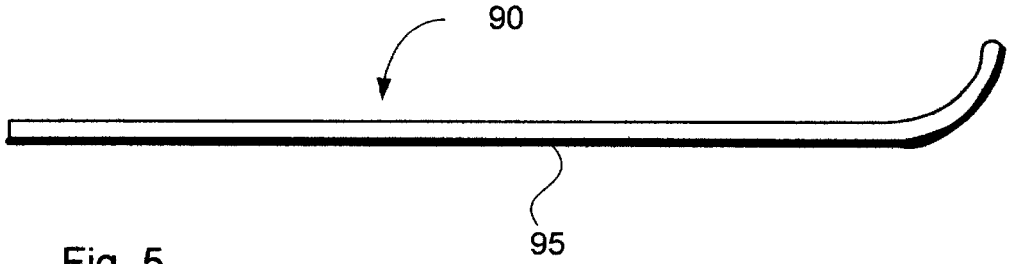
FIG. 5 is a schematic side elevation of a ski having a Nitinol base in accordance with this invention.

Turning now to FIG. 5, a ski 90 is shown having a Nitinol base 95. The base may be Type 55 Martensitic Nitinol or may be superelastic Nitinol. The superior damping capacity of 55 Martensitic Nitinol would make it a highly damped. Moreover, 55 Nitinol has a shape memory effect, so that dents and grooves created by skiing over rocks and the like could be removed merely by heating the base 95 with a blow drier or a pressing iron to a temperature above the transition temperature of the Nitinol, whereupon the dents and grooves would spontaneously disappear and the surface would be restored to its original smoothness. Superelastic Nitinol does not have the shape memory effect, but it is much stronger than 55 Nitinol and has a "pseudo-elastic" range of about 7% so it would not be as likely to suffer plastic deformation so it would not be as likely to suffer permanent dents and gouges. Moreover, superelastic Nitinol is much stiffer than 55 Nitinol and does have good damping capacity, so the ski with a superelastic base 95 would be stiff and damped. The stiffness of superelastic Nitinol can be adjusted by the heat treatment.

Referring back to FIG. 3, the edge pieces 100 (only one of which is shown in FIG. 3) along each longitudinal edge of the ski 45 are bonded in place by an adhesive, the same adhesive that holds the top and bottom sheets 44 and 50 to the core 48. In accordance with this invention, these edge pieces may be made of Nitinol to provide superior edge holding ability and to be immune to rust and corrosion. The material of the edge is preferably superelastic Nitinol because of its hardness and property of increasing in strength when subjected to cold work. Thus, the edge piece would not be so strong and stiff that it would interfere with the desired stiffness of the ski, but its strength would increase when it encounters a rock and thereby avoid damage that a normal end piece would sustain. The edge piece 100 could also be made of Type 60 Nitinol, which is an intermetallic compound of 60% by weight nickel and 40% by weight titanium. Type 60 Nitinol is very hard material, on the order of 55–62 RC, depending on the heat treatment, so it would be very good at holding an edge and resisting damage from contact with rocks. Type 60 Nitinol, like the two other types, is corrosion-proof.

Figure 6:
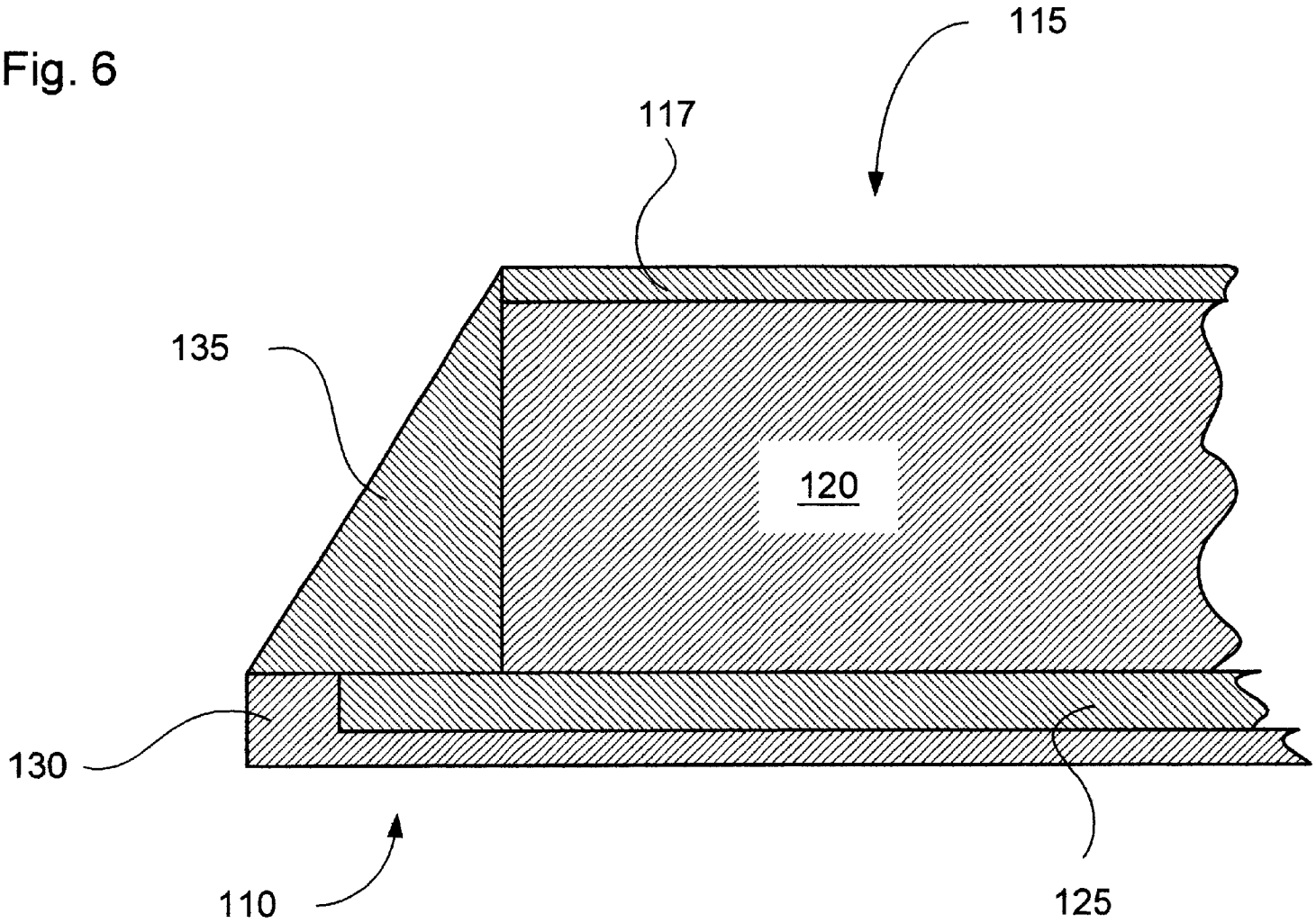
FIG. 6 is a sectional end elevation of a ski in accordance with this invention having an integral edge and base structure of Nitinol.

Turning now to FIG. 6, an integral edge and ski base 110 is shown on a ski 115. As in the ski shown in FIG. 3, a top plate 117 may be bonded to a core 120, such as laminated wood, as is known in the industry. The integrated edge and base structure 110 may be made by plasma spraying super-elastic Nitinol onto a cleaned aluminum plate 125 which forms a diffusion bond between the Nitinol and the aluminum plate 125. The thickened edge portion 130 is formed at the same time by filling the space between the edge of the aluminum plate and a stainless steel form that is polished to prevent the Nitinol from sticking. The top surface of the aluminum plate 125 bonds readily to the core 120 and the fiberglass beveled ski side 135. This structure gives no edge for a rock to hook into and tear the ski edge out, as is possible with the ski shown in FIG. 3.

Figure 7:
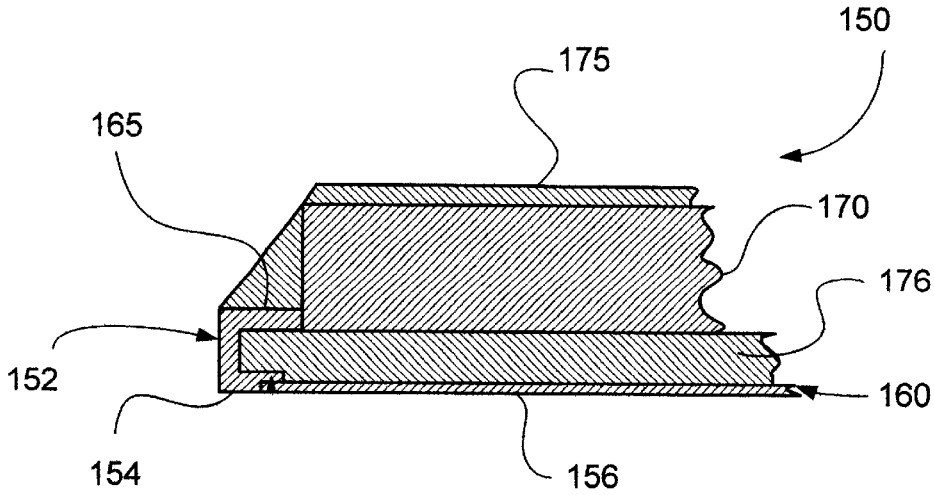
FIG. 7 is a sectional elevation of a ski having a Nitinol ski edge structure and a Nitinol base sheet.
Figure 8:
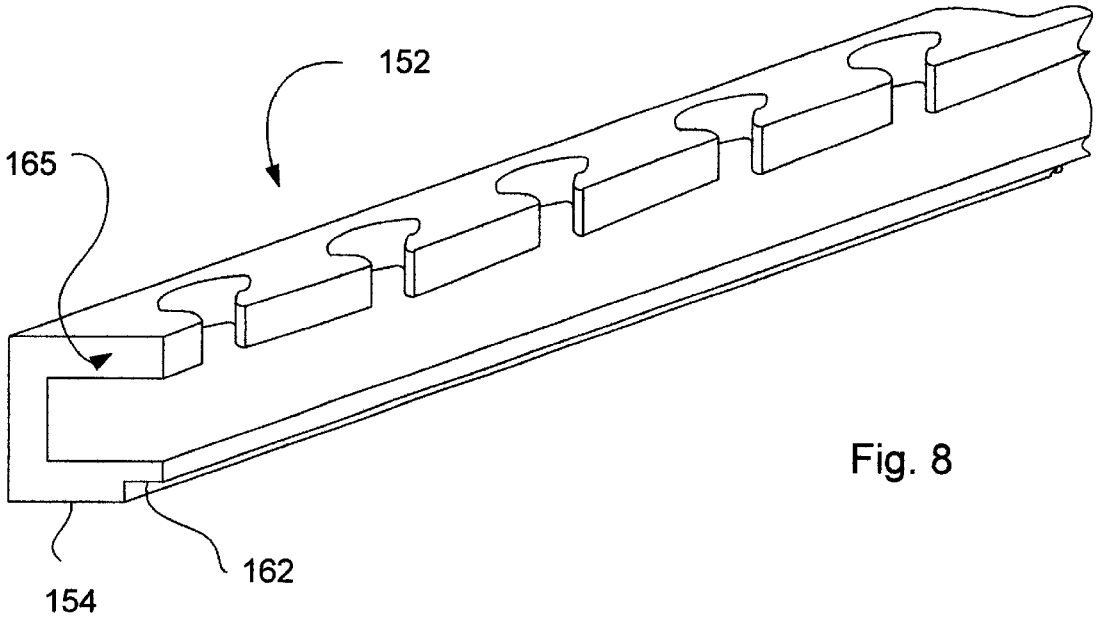
FIG. 8 is a perspective view of the Nitinol ski edge structure shown in FIG. 7.

A ski 150 shown in FIGS. 7 and 8 includes a Nitinol ski edge structure 152 extending longitudinally along both of the ski edges (only one of which is shown in FIG. 7) and having a bottom surface 154 flush with the bottom surface 156 of a ski base sheet 160. A shallow recess 162 extends longitudinally along the full length of the inside bottom edge of the edge structure 152 to receive one edge of the ski base sheet 160 where it is welded by laser welding or tungsten inert gas arc. The ski base sheet 160 is preferably super-elastic Nitinol or martensitic 55 Nitinol having shape memory characteristics as noted above.

The ski edge structure 152 is preferably cast from Type 60 Nitinol using an investment casting process. The edge structure 152 has a top flange 165 having a series of key-hole notches along its inner edge by which the edge structure is locked in the ski when the epoxy bonding the elements of the ski together cures. The cast edge structure is treated in a hot isostatic press at 1760° F. for several hours at 1500 PSI to consolidate the as-cast structure, and then is ground and polished on the outside and bottom edges. It is then heat treated to about 900° C. and water quenched to make to tough and give it a lasting oxide finish.

The edge structures are welded to the outside longitudinal edges of the base sheet 160 and the ski elements, including the ski core 170, the top sheet 175, the bottom sheet 176 of epoxy-impregnated fiberglass or the like, and the edge/base sheet assembly, are all assembled in a ski mold and are pressed in the mold while heating. The epoxy cures quickly under heat and pressure and forms a strong flexible ski 150 with durable edges and extremely low friction base.

Figure 9:
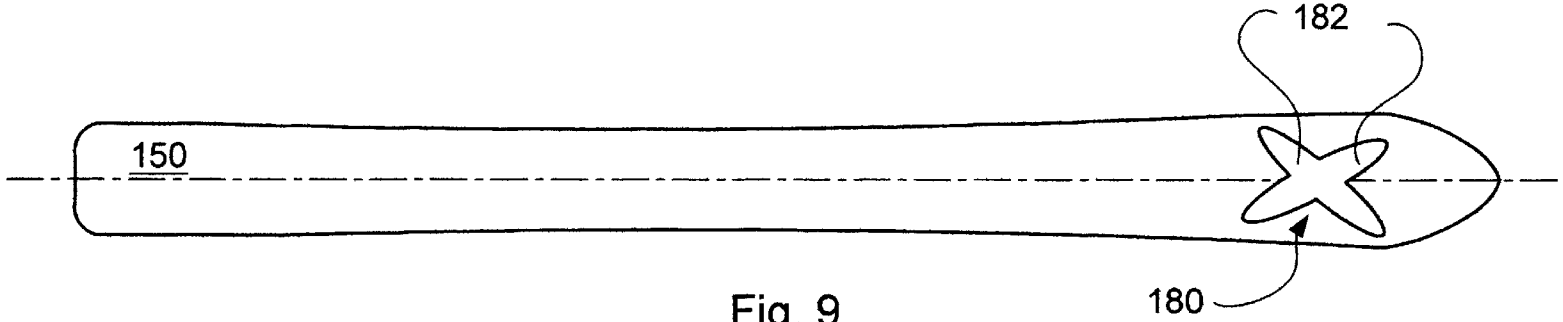
FIG. 9 is a plan view of a ski with an embedded Nitinol torsional vibration absorber structure.
Figure 10:
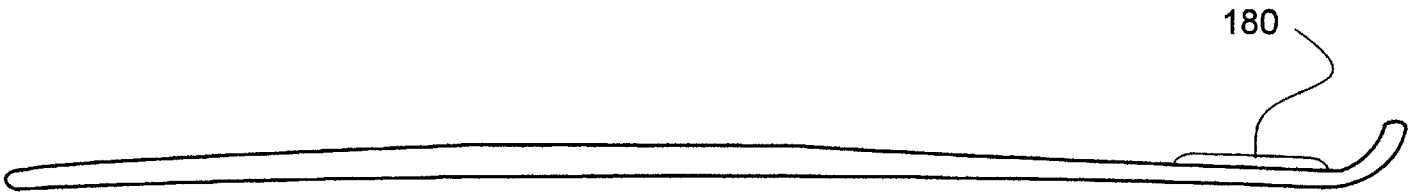
FIG. 10 is an elevation of the ski shown in FIG. 9.

Torsional stiffening may be provided by at least one vibration absorbing member made of Nitinol embedded in the ski and attached thereto in such a way that flexing and vibration of the ski causes straining of the Nitinol member, whereby a portion of vibration energy in the ski during skiing is absorbed by the Nitinol member to damp the vibration. One torsional vibration absorber, shown in FIGS. 9 and 10, includes a Nitinol pad 180 having structure extending along two crossed axes lying oblique to the longitudinal axis of the ski. The vibration absorbing member 180 can be provided with arms 182 extending along the two oblique axes and terminating short of the longitudinal edges of the ski. The pad 180 is on the order of about 0.020"–0.070" thick and can be placed over the top sheet of the ski where it is visible for marketing interest. The under surface of the pad should be roughened or grooved to ensure good bonding to the ski since it must be strained during torsional flexing of the ski to provide damping of the torsional vibration.

Figure 11:
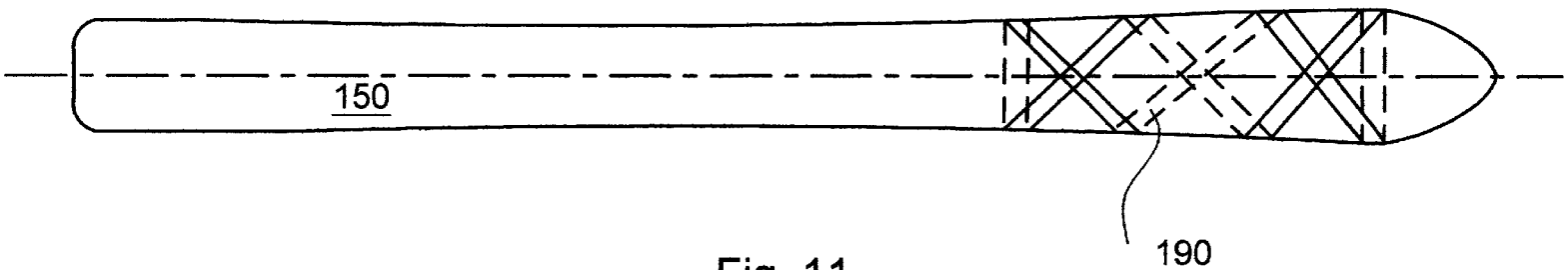
FIG. 11 is a plan view of a ski core having a torsional vibration absorber in the form of a Nitinol ribbon wrapped around the core in a double helix.

A second form of torsional damping that does not depending on adhesion of the Nitinol structure is shown in FIG. 11. The vibration absorbing member shown in FIG. 11 includes an elongated ribbon 190 of Nitinol wrapped in a double helix around the core 170 of the ski. The ribbon is preferably Martensitic Type 55 Nitinol having a thickness on the order of 0.010"–0.70", preferably about 0.050", and having a width of about ¾"–2", preferably about 1" wide. As shown, there are about four complete wraps of Nitinol ribbon around the ski core, and the ends of the ribbon are welded together or crimped together to prevent the ribbon from creeping during torsional flexing of the ski, so the ribbon 190 will be strained and will absorb torsional vibration energy.

The invention disclosed herein utilizes various Nitinol elements attached to or embedded in the ski to improved its function. For purposes of definition in the following claims, I intend the term "integral with" to encompass both "attached to" and "embedded in".

Obviously, numerous modifications and variations of the preferred embodiment described above are possible and will become apparent to those skilled in the art in light of this specification. For example, many functions and advantages are described for the preferred embodiment, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, are to be considered within the spirit and scope of the invention as set forth in the following claims, Wherein I claim:

1. A ski having a longitudinal axis and two longitudinal edges along opposite sides of a snow-contacting base, comprising:

at least one vibration absorbing member made of Nitinol integral with said ski and coupled thereto in such a way that flexing and vibration of said ski causes straining of said Nitinol member, whereby a portion of vibration energy in said ski during skiing is absorbed by said Nitinol member to damp said vibration.

2. A ski as defined in claim 1, wherein:

said vibration absorbing member has Nitinol structure extending along an axis lying oblique to said longitudinal axis of said ski.

3. A ski as defined in claim 2, wherein:

said vibration absorbing member has arms extending along at least two axes oblique to said longitudinal axis and terminating short of said longitudinal edges of said ski.

4. A ski as defined in claim 2, wherein:

said vibration absorbing member includes an elongated ribbon of Nitinol wrapped in a double helix around a core of said ski.

5. A ski as defined in claim 4, wherein:

said ribbon is Martensitic Type 55 Nitinol having a thickness on the order of 0.010"–0.30" and less than 2" wide.

6. A ski as defined in claim 1, wherein:

said base is a sheet of Nitinol.

7. A ski as defined in claim 1, further comprising:

an adjustment mechanism for exerting an adjustable preload on said vibration absorbing member.

8. A ski as defined in claim 1, further comprising:

a Nitinol ski edge structure extending longitudinally along both of said ski edges and having a bottom surface flush with said base.

9. A ski having a longitudinal axis and two longitudinal edges along opposite sides of a snow-contacting base, comprising:

a vibration absorbing member coupled to said ski in such a way that flexing and vibration of said ski causes straining of said member;

said vibration absorbing member is made of Nitinol;

whereby a portion of vibration energy induced in said ski during skiing is absorbed by said Nitinol member to damp said vibration.

10. A ski as defined in claim 9, wherein said vibration absorbing member includes a Nitinol sheet constituting said snow-contacting base of said ski, said sheet having two opposed longitudinal edges on opposite sides of an elongated medial portion.

11. A ski as defined in claim 10, further comprising:

a Nitinol ski edge structure extending longitudinally along both of said edges of said sheet and having a greater thickness than said medial portion of said sheet, said edge structures forming an integral part of said Nitinol sheet.

12. A ski as defined in claim 11, wherein:

said sheet is welded along opposite edges thereof to said edge structures.

13. A ski as defined in claim 11, wherein:

said ski edge structure is Type 60 Nitinol.

14. A ski as defined in claim 10, wherein:

said sheet is superelastic Nitinol.

15. A ski as defined in claim 10, wherein:

said sheet is Martensitic Nitinol having shape memory characteristics.

16. A ski as defined in claim 9, wherein:

said vibration absorbing member has Nitinol structure extending along an axis lying oblique to said longitudinal axis of said ski.

* * * * *